US011998150B2

(12) United States Patent
Innes et al.

(10) Patent No.: US 11,998,150 B2
(45) Date of Patent: Jun. 4, 2024

(54) VACUUM CLEANER AND DOCKING STATION FOR USE WITH THE SAME

(71) Applicant: SharkNinja Operating, LLC, Needham, MA (US)

(72) Inventors: Daniel J. Innes, West Roxbury, MA (US); Andre D. Brown, Natick, MA (US); Jason B. Thorne, Dover, MA (US); Kai Xu, Suzhou (CN); Sam Liu, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 595 days.

(21) Appl. No.: 16/864,538

(22) Filed: May 1, 2020

(65) Prior Publication Data

US 2020/0345196 A1 Nov. 5, 2020

Related U.S. Application Data

(60) Provisional application No. 62/841,548, filed on May 1, 2019.

(51) Int. Cl.
*A47L 11/40* (2006.01)
*A47L 9/10* (2006.01)
(Continued)

(52) U.S. Cl.
CPC ..... *A47L 11/4025* (2013.01); *A47L 9/12* (2013.01); *A47L 9/20* (2013.01); *A47L 9/2873* (2013.01);
(Continued)

(58) Field of Classification Search
CPC ..... A47L 11/4025; A47L 9/12; A47L 9/20; A47L 9/2873; A47L 11/4033;
(Continued)

(56) References Cited

U.S. PATENT DOCUMENTS 3,954,426 A 5/1976 Brange
5,198,111 A 3/1993 Davis
(Continued)

FOREIGN PATENT DOCUMENTS

CN 105708389 6/2016
CN 106963286 7/2017
(Continued)

OTHER PUBLICATIONS

PCT Search Report and Written Opinion, dated Jul. 22, 2020, received in corresponding PCT Application No. PCT/US2020/030991, 8 pages.
(Continued)

*Primary Examiner* — David Redding
(74) *Attorney, Agent, or Firm* — Grossman Tucker Perreault & Pfleger, PLLC

(57) ABSTRACT

A docking station for a vacuum cleaner may include a receptacle configured to engage at least a portion of the vacuum cleaner such that, in response to engaging the receptacle, a vacuum cleaner flow path extending within the vacuum cleaner is transitioned from a cleaning flow path to an evacuation flow path, a suction motor of the vacuum cleaner being configured to urge air along the vacuum cleaner flow path and a docking station dust cup configured to receive debris from a vacuum cleaner dust cup of the vacuum cleaner.

18 Claims, 16 Drawing Sheets

(51) Int. Cl.

| | |
|---|---|
| ***A47L 9/12*** | (2006.01) |
| ***A47L 9/14*** | (2006.01) |
| ***A47L 9/20*** | (2006.01) |
| ***A47L 9/28*** | (2006.01) |

(52) U.S. Cl.
CPC ..... *A47L 11/4033* (2013.01); *A47L 11/4091* (2013.01); *A47L 9/106* (2013.01); *A47L 9/149* (2013.01); *A47L 2201/024* (2013.01)

(58) Field of Classification Search
CPC ..... A47L 11/4091; A47L 9/106; A47L 9/149; A47L 2201/024; A47L 9/0063; A47L 9/127; A47L 9/1666; A47L 9/1683; A47L 9/1691; A47L 5/30; A47L 9/10; A47L 9/28
See application file for complete search history.

(56) References Cited

U.S. PATENT DOCUMENTS

| | | | | |
|---|---|---|---|---|
| 6,122,796 | A | 9/2000 | Downham et al. | |
| 6,991,666 | B2 | 1/2006 | Organ | |
| 7,059,012 | B2 | 6/2006 | Song et al. | |
| 7,288,129 | B2 | 10/2007 | Oh et al. | |
| 7,412,748 | B2 | 8/2008 | Lee et al. | |
| 7,785,381 | B2 | 8/2010 | Oh et al. | |
| 7,849,555 | B2 | 12/2010 | Hahm et al. | |
| 7,951,214 | B2 | 5/2011 | Menrik et al. | |
| 8,069,529 | B2 | 12/2011 | Groff et al. | |
| 8,156,609 | B2 | 4/2012 | Milne et al. | |
| 8,163,051 | B2 | 4/2012 | Yun et al. | |
| 8,635,739 | B2 | 1/2014 | Lee et al. | |
| 8,640,304 | B2 | 2/2014 | Conrad | |
| 8,695,157 | B2 | 4/2014 | Beskow et al. | |
| 8,955,193 | B2 | 2/2015 | Ha et al. | |
| 9,271,618 | B2 | 3/2016 | Mantyla et al. | |
| 9,462,920 | B1 | 10/2016 | Morin et al. | |
| 9,526,391 | B2 | 12/2016 | Lee et al. | |
| 9,788,698 | B2 | 10/2017 | Morin et al. | |
| 9,808,135 | B2 | 11/2017 | Mantyla et al. | |
| 10,136,778 | B2 | 11/2018 | Conrad | |
| 10,244,910 | B2 | 4/2019 | Conrad | |
| 10,512,381 | B2 | 12/2019 | Meggle et al. | |
| 10,791,891 | B2 | 10/2020 | Kuhe et al. | |
| 10,952,578 | B2 | 3/2021 | Gill et al. | |
| 11,213,177 | B2 | 1/2022 | Tonderys et al. | |
| 2008/0201895 | A1* | 8/2008 | Kim | A47L 9/106 901/1 |
| 2013/0305481 | A1* | 11/2013 | Jung | A47L 11/33 15/301 |
| 2014/0137364 | A1 | 5/2014 | Stickney et al. | |
| 2015/0135470 | A1 | 5/2015 | Mantyla et al. | |
| 2015/0196859 | A1 | 7/2015 | Levitt | |
| 2015/0230677 | A1 | 8/2015 | Andrikanish | |
| 2016/0166126 | A1* | 6/2016 | Morin | A47L 9/2857 15/319 |
| 2016/0374528 | A1 | 12/2016 | Morin et al. | |
| 2017/0001136 | A1 | 1/2017 | Hensel et al. | |
| 2017/0196420 | A1 | 7/2017 | Brown et al. | |
| 2018/0078107 | A1 | 3/2018 | Gagnon et al. | |
| 2018/0177358 | A1 | 6/2018 | Conrad | |
| 2018/0228335 | A1 | 8/2018 | Miller | |
| 2019/0090701 | A1 | 3/2019 | Tonderys et al. | |
| 2019/0125153 | A1 | 5/2019 | Loveless et al. | |
| 2020/0345196 | A1 | 11/2020 | Innes et al. | |
| 2021/0045600 | A1 | 2/2021 | Schmitz et al. | |
| 2021/0052121 | A1 | 2/2021 | Kim et al. | |
| 2022/0015593 | A1 | 1/2022 | Conrad | |
| 2022/0022712 | A1 | 1/2022 | Gadient et al. | |
| 2022/0031134 | A1 | 2/2022 | Yang et al. | |
| 2022/0047133 | A1 | 2/2022 | Sergyeyenko et al. | |
| 2022/0061614 | A1 | 3/2022 | Yu et al. | |
| 2022/0175206 | A1 | 6/2022 | Li et al. | |
| 2023/0117115 | A1 | 4/2023 | Choi et al. | |
| 2023/0148812 | A1 | 5/2023 | Yang et al. | |

FOREIGN PATENT DOCUMENTS

| | | | |
|---|---|---|---|
| CN | 113317716 | | 8/2021 |
| CN | 216135772 | | 3/2022 |
| DE | 102012109938 | * | 4/2014 |
| DE | 102015100057 | | 7/2016 |
| DE | 102019004417 | | 12/2020 |
| ES | 2238196 | | 8/2005 |
| JP | 2004283327 | | 10/2004 |
| KR | 20070094288 | | 9/2007 |
| KR | 102354485 | | 1/2022 |
| WO | WO2016146555 | * | 9/2016 |
| WO | 2020122631 | | 6/2020 |
| WO | 2021177699 | | 9/2021 |
| WO | 2022010198 | | 1/2022 |
| WO | 2023018048 | | 2/2023 |

OTHER PUBLICATIONS

"Ovation HT107 Cordless Folding 2-in-1 Upright and Handheld Stick Vac Vacuum Cleaner with 180 Swivel Steering System", www.amazon.co.uk/Ovation-Cordless-Handheld-Steering-Upholstery, Jan. 14, 2019, 7 pages.

Chinese Office Action with English translation dated Jun. 21, 2022, received in Chinese Patent Application No. 202080047897.7, 25 pages.

U.S. Office Action dated May 30, 2023 received in U.S. Appl. No. 18/085,009, 24 pages.

PCT Search Report and Written Opinion dated Jun. 1, 2023, received in PCT Application No. PCT/CN2022/118922, 12 pages.

* cited by examiner

VACUUM CLEANER AND DOCKING STATION FOR USE WITH THE SAME

CROSS-REFERENCE TO RELATED APPLICATIONS

The present application claims the benefit of U.S. Provisional Application Ser. No. 62/841,548 filed on May 1, 2019, entitled Docking Station for Vacuum Cleaner, which is fully incorporated herein by reference

TECHNICAL FIELD

The present disclosure is generally related to surface treatment apparatuses and more specifically related to vacuum cleaners and docking stations for use therewith.

BACKGROUND INFORMATION

Surface treatment apparatuses can include upright vacuum cleaners configured to be transitionable between a storage position and an in-use position. Upright vacuum cleaners can include a suction motor configured to draw air into an air inlet of the upright vacuum cleaner such that debris deposited on a surface can be urged into the air inlet. At least a portion of the debris urged into the air inlet can be deposited within a dust cup of the upright vacuum cleaner for later disposal.

BRIEF DESCRIPTION OF THE DRAWINGS

These and other features and advantages will be better understood by reading the following detailed description, taken together with the drawings, wherein.

DETAILED DESCRIPTION

The present disclosure is generally related to a docking station for use with a vacuum cleaner. An example docking station is configured to alter an airflow path within the vacuum cleaner such that airflow generated by a suction motor of the vacuum cleaner can be used to, for example, urge debris within a vacuum cleaner dust cup into a docking station dust cup. Evacuation of debris from the vacuum cleaner dust cup to the docking station dust cup, when at least a portion of the vacuum cleaner engages (e.g., contacts) the docking station, may allow the vacuum cleaner dust cup to have a decreased volume, which may reduce the size and/or weight of the vacuum cleaner.

Figure 1:
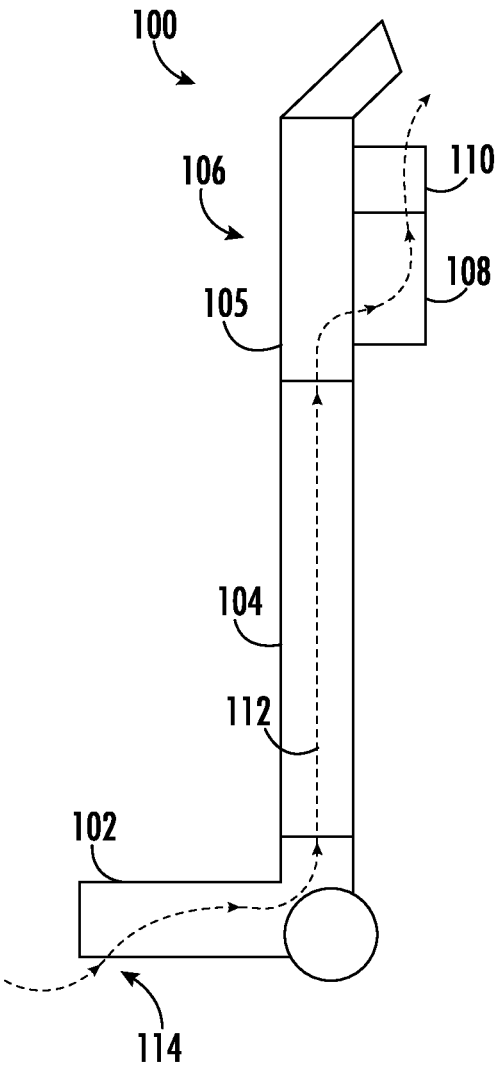
FIG. 1 is a schematic side view of an example of a vacuum cleaner, consistent with embodiments of the present disclosure.

FIG. 1 shows a schematic example of a vacuum cleaner 100. As shown, the vacuum cleaner 100 includes a surface cleaning head 102, a wand 105 coupled to a wand extension 104 such that the wand 105 and wand extension 104 are fluidly coupled to the surface cleaning head 102, and a vacuum assembly 106 fluidly coupled to the wand 105. The vacuum assembly 106 can include a vacuum cleaner dust cup 108 and a suction motor 110. The suction motor 110 is configured urge air along a cleaning flow path 112. The cleaning flow path 112 can extend from an inlet 114 of, for example, the surface cleaning head 102 through the wand extension 104 and the wand 105 into the vacuum cleaner dust cup 108 through suction motor 110 and into a surrounding environment.

The vacuum assembly 106 can be decoupled from the wand extension 104 such that the vacuum assembly 106 can be used independently from the wand extension 104 and/or surface cleaning head 102. For example, the vacuum assembly 106 can be configured to be coupled to additional vacuum cleaning accessories when decoupled from the wand extension 104 and/or the surface cleaning head 102. In some instances, the wand extension 104 and vacuum assembly 106 can be collectively decoupled from the surface cleaning head 102 such that the vacuum assembly 106 and wand extension 104 can be used independently of the surface cleaning head 102.

Figure 2:
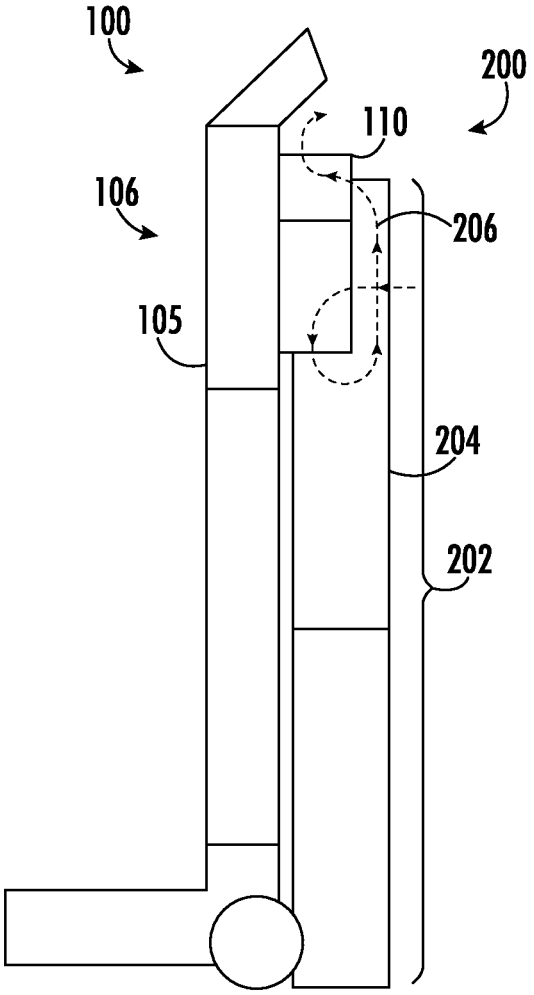
FIG. 2 is a schematic side view of an example of the vacuum cleaner of FIG. 1 engaging an example of a docking station, consistent with embodiments of the present disclosure.

FIG. 2 shows a schematic example of the vacuum cleaner 100 of FIG. 1 engaging (e.g., contacting) a docking station 200. The docking station 200 can include an upright section 202 and a docking station dust cup 204 coupled to the upright section 202 and configured to receive debris from the vacuum cleaner dust cup 108. When the vacuum cleaner 100 is brought into engagement with the docking station 200 (e.g., the vacuum assembly 106 is brought into engagement with the docking station 200), the cleaning flow path 112 of FIG. 1 is caused to transition into an evacuation flow path 206 by bypassing the wand extension 104 and the surface cleaning head 102. In other words, a vacuum cleaner flow path extending within the vacuum cleaner 100 (e.g., the vacuum assembly 106) is caused to transition from the cleaning flow path 112 to the evacuation flow path 206, wherein the suction motor 110 is configured to urge air to flow along the vacuum cleaner flow path. As shown, the evacuation flow path 206 extends from the vacuum cleaner dust cup 108 into the docking station dust cup 204 through the suction motor 110 and into the surrounding environment. As such, debris deposited within the vacuum cleaner dust cup 108 is urged into the docking station dust cup 204 using air flowing along the evacuation flow path 206, the airflow being generated by the suction motor 110 of the vacuum cleaner 100.

Figure 3:
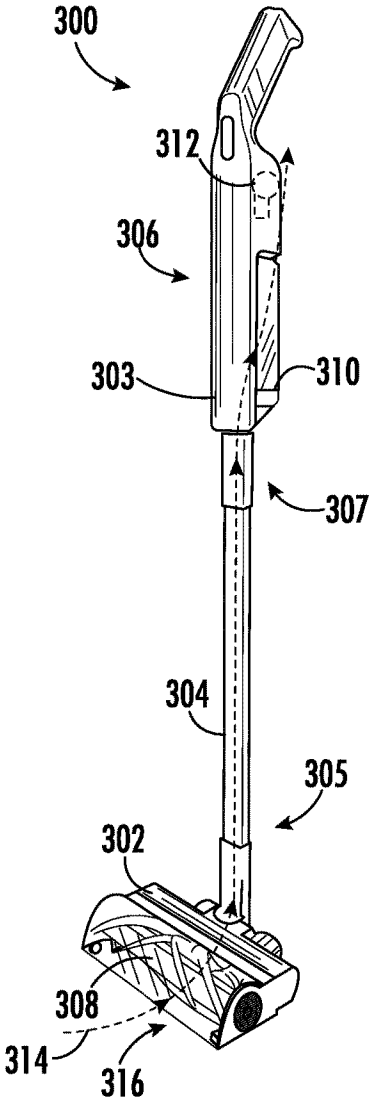
FIG. 3 is a perspective view of an example of a vacuum cleaner, consistent with embodiments of the present disclosure.

FIG. 3 shows a perspective view of a vacuum cleaner 300, which may be an example of the vacuum cleaner 100 of FIG. 1. As shown, the vacuum cleaner 300 includes a surface cleaning head 302, a wand 303 coupled to a wand extension 304, the wand 303 and wand extension 304 being fluidly coupled to the surface cleaning head 302, and a vacuum assembly 306 fluidly coupled to the wand 303. As shown, a first end 305 of the wand extension 304 can be coupled to the surface cleaning head 302 and a second end 307 of the wand extension 304 can be coupled to the wand 303. The surface cleaning head 302 includes one or more agitators 308 (e.g., brush rolls) configured to rotatably engage a surface to be cleaned (e.g., a floor). In some instances, the surface cleaning head 302 can include a power source (e.g., one or more batteries) configured to power one or more motors such that the one or more agitators 308 are rotated. Additionally, or alternatively, a power source (e.g., one or more batteries) may be included with, for example, the vacuum assembly 306. In instances where the vacuum cleaner 300 includes a plurality of power sources (e.g., one in the surface cleaning head 302 and one in the vacuum assembly 306) a docking station (see, e.g., FIG. 4) may include a plurality of charging points, each corresponding to a respective power source.

The vacuum assembly 306 includes a vacuum cleaner dust cup 310 and a suction motor 312 (shown schematically in hidden lines). The suction motor 312 is configured to cause air to be moved along a cleaning flow path 314. As shown, the cleaning flow path 314 extends from an air inlet 316 of the surface cleaning head 302 through the wand extension 304 and wand 303 into the vacuum cleaner dust cup 310 through the suction motor 312 and into a surrounding environment. In some instances, the one or more agitators 308 may be caused to rotate in response to air flowing along the cleaning flow path 314. For example, a pressure sensor may be included along the cleaning flow path 314 to detect a change in pressure (e.g., a generation of suction) along the cleaning flow path 314. Upon detecting a change in pressure, the pressure sensor may cause power to be transmitted to one or more motors configured to rotate the one or more agitators 308.

Figure 4:
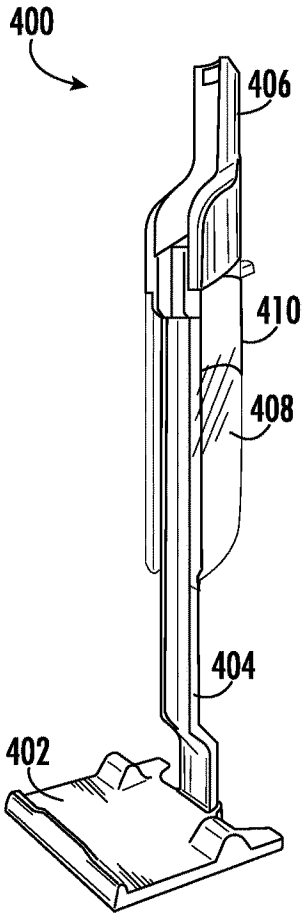
FIG. 4 is a perspective view of an example of a docking station configured to engage, for example, the vacuum cleaner of FIG. 3, consistent with embodiments of the present disclosure.

FIG. 4 shows a perspective view of a docking station 400, which may be an example of the docking station 200 of FIG. 2. As shown, the docking station 400 includes a base 402 configured to receive the surface cleaning head 302 of the vacuum cleaner 300, an upright section 404 extending from the base 402, a vacuum assembly receptacle 406 configured to receive (e.g., engage) at least a portion of the vacuum assembly 306, and a docking station dust cup 408 fluidly coupled to the vacuum assembly receptacle 406. The vacuum assembly receptacle 406 can be coupled to the upright section 404. For example, the base 402 and the vacuum assembly receptacle 406 may be coupled to the upright section 404 at opposing end regions of the upright section 404.

Figure 5:
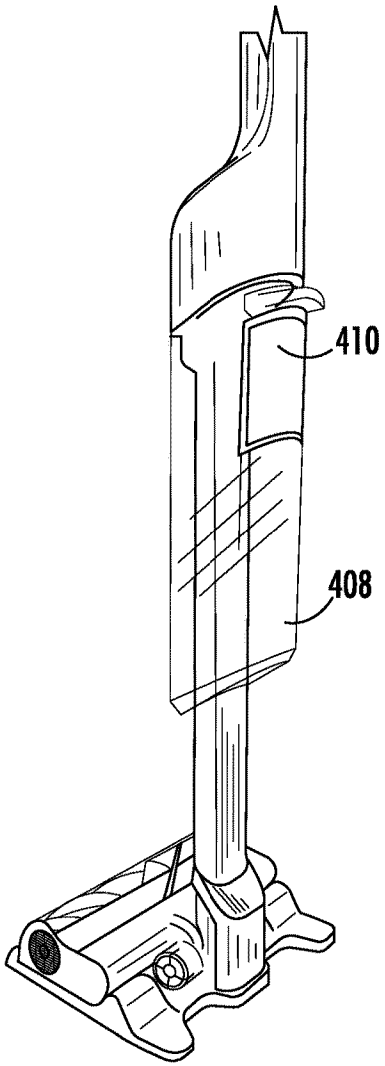
FIG. 5 is another perspective view of the docking station of FIG. 4, consistent with embodiments of the present disclosure.
Figure 6:
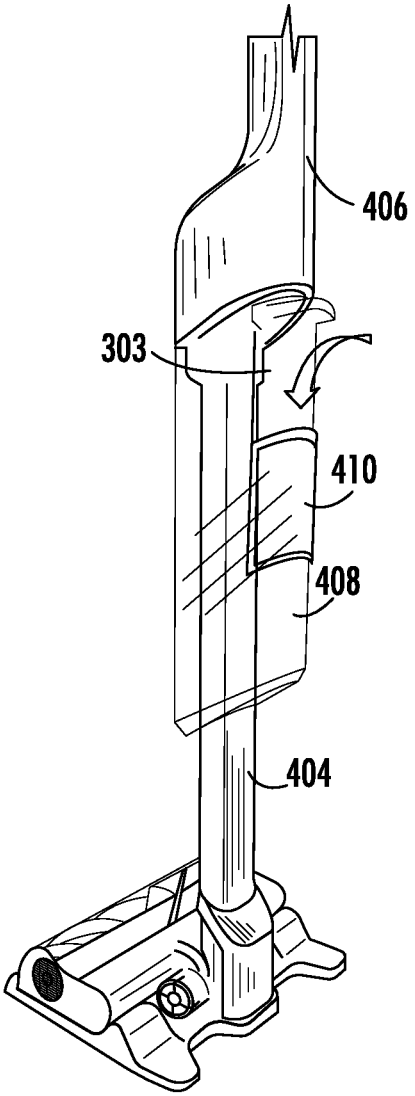
FIG. 6 is another perspective view of the docking station of FIG. 4, consistent with embodiments of the present disclosure.

The docking station dust cup 408 includes a dust cup hatch 410 configured to transition between a closed position (see FIG. 5) and an open position (see FIG. 6). The dust cup hatch 410 can be biased (e.g., using a spring) towards the closed position. When the dust cup hatch 410 is in the open position, a user of the docking station 400 can place debris into the docking station dust cup 408 for later disposal.

Figure 7:
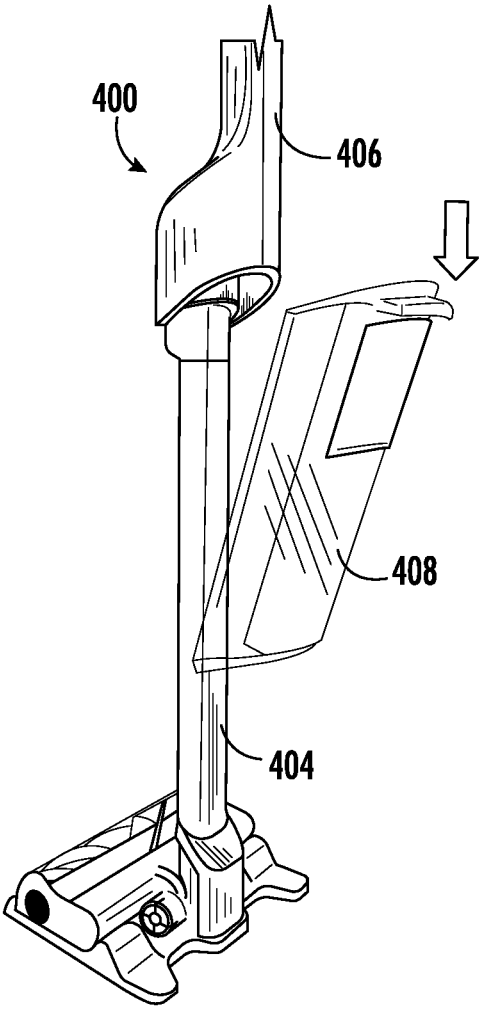
FIG. 7 is another perspective view of the docking station of FIG. 4, consistent with embodiments of the present disclosure.

As shown in FIG. 7, the docking station dust cup 408 can be removed from the docking station 400 such that the docking station dust cup 408 can be emptied. The docking station dust cup 408 can be configured to be removably coupled to a portion of the docking station 400 (e.g., the upright section 404 and/or the vacuum assembly receptacle 406) using, for example, a press-fit and/or snap-fit. Additionally, or alternatively, the docking station dust cup 408 can be configured to be removably coupled to the docking station 400 using, for example, an actuatable latch.

Figure 8:
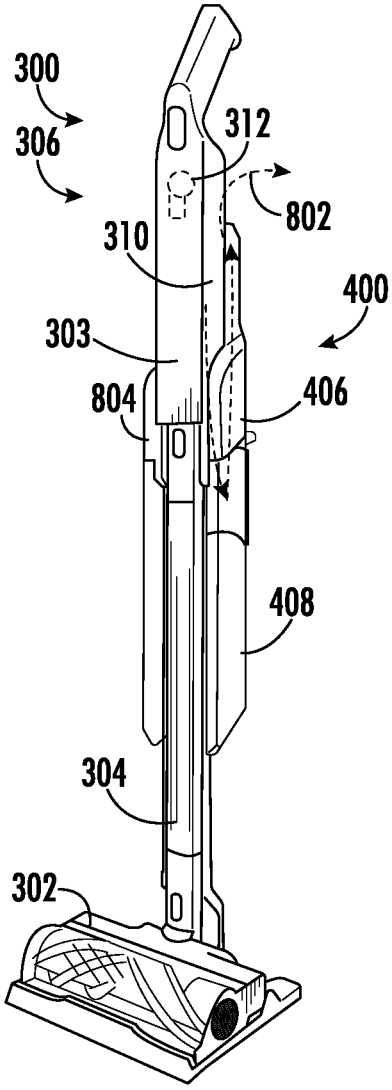
FIG. 8 is a perspective view of the docking station of FIG. 4 engaging the vacuum cleaner of FIG. 3, consistent with embodiments of the present disclosure.

FIG. 8 shows a perspective view of the vacuum cleaner 300 engaging the docking station 400. As shown, at least a portion of the vacuum assembly 306 is received by the vacuum assembly receptacle 406. The vacuum assembly receptacle 406 is configured to cause the cleaning flow path 314 to transition to an evacuation flow path 802. The evacuation flow path 802 bypasses the wand extension 304 and surface cleaning head 302 such that the vacuum cleaner dust cup 310 is fluidly coupled to the docking station dust cup 408. As such, the suction motor 312 can cause debris within the vacuum cleaner dust cup 310 to be urged into the docking station dust cup 408.

Figure 9:
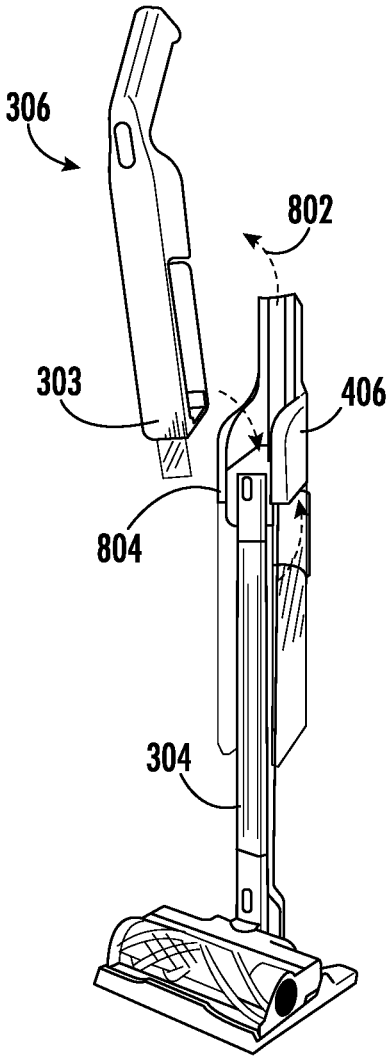
FIG. 9 is a perspective view of the docking station and vacuum cleaner of FIG. 8, wherein a vacuum assembly of the vacuum cleaner is decoupled from a wand extension and surface cleaning head of the vacuum cleaner, consistent with embodiments of the present disclosure.

The vacuum assembly receptacle 406 can include a release 804 configured to cause the vacuum assembly 306 to disengage the wand extension 304 and the vacuum assembly receptacle 406 (see FIG. 9). When disengaged from the wand extension 304, the vacuum assembly 306 can be coupled to one or more cleaning accessories (e.g., a crevice cleaning tool).

Figure 10:
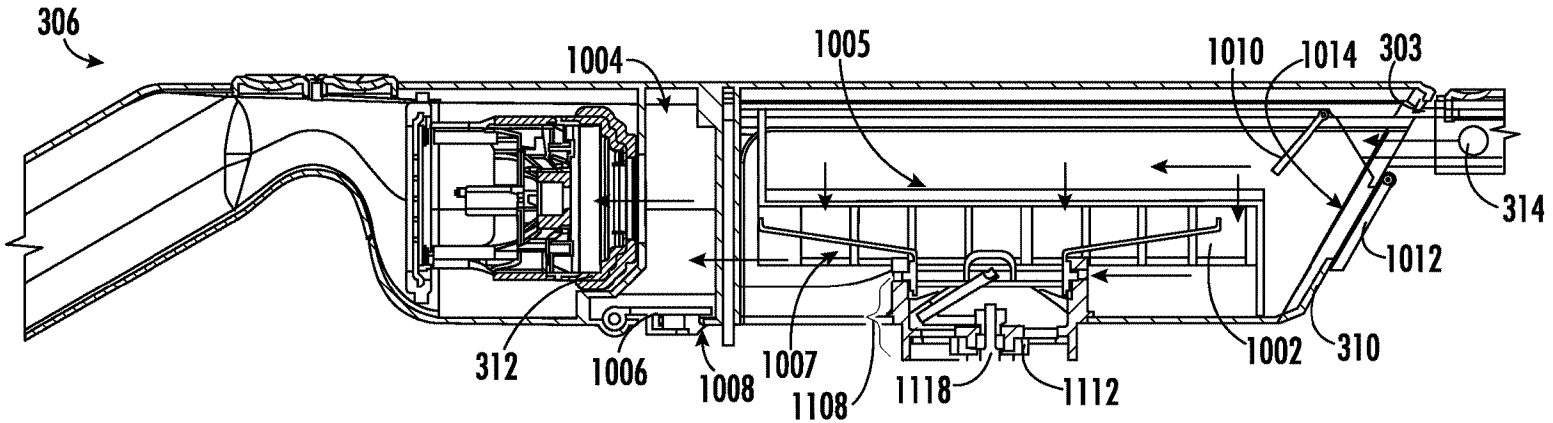
FIG. 10 is a cross-sectional view of a portion of the vacuum cleaner of FIG. 3, consistent with embodiments of the present disclosure.

FIG. 10 shows a cross-sectional view of an example of the vacuum assembly 306 and the wand 303 disengaged from the docking station 400. As shown, when disengaged from the docking station 400, air flows according to the cleaning flow path 314. The cleaning flow path 314 extends from the wand 303 into the vacuum cleaner dust cup 310 through a filter medium 1002 of the vacuum assembly 306 into a premotor chamber 1004 and through the suction motor 312. The filter medium 1002 may extend within or define a portion of the vacuum cleaner dust cup 310. As shown, air flowing through the filter medium 1002 according to the cleaning flow path 314 flows from a debris collection side 1005 of the filter medium 1002 to a clean side 1007 of the filter medium 1002. This may generally be referred to as a forward direction of air flow through the filter medium 1002. The filter medium 1002 may be a mesh filter, a high-efficiency particulate air (HEPA) filter, and/or any other type of filter.

Figure 11A:
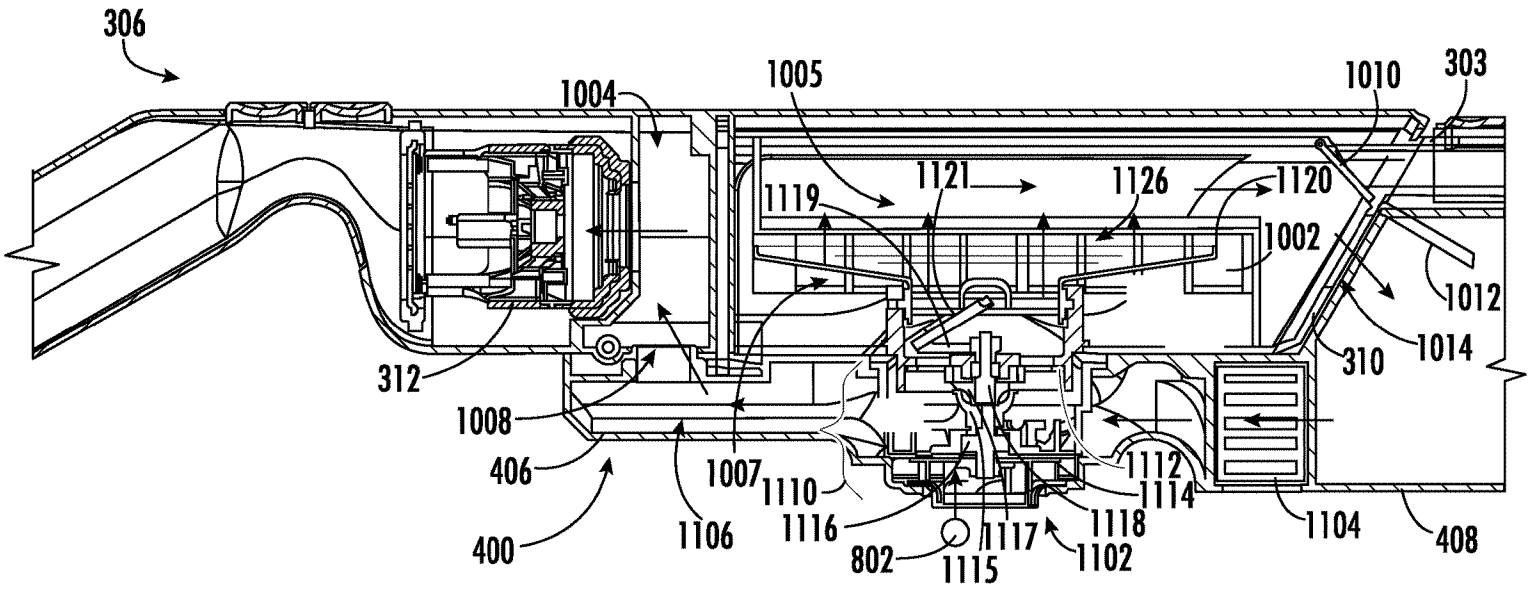
FIG. 11A is a cross-sectional view of a portion of the vacuum cleaner of FIG. 3 engaging the docking station of FIG. 4, consistent with embodiments of the present disclosure.
Figure 11C:
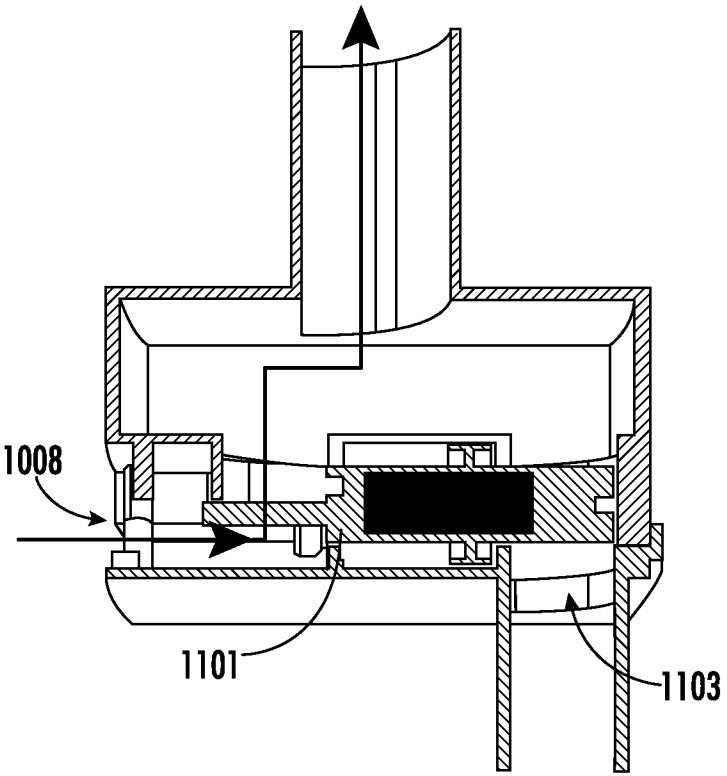
FIG. 11C shows an example of the actuatable valve of FIG. 11B in an evacuation position, consistent with embodiments of the present disclosure.
Figure 11B:
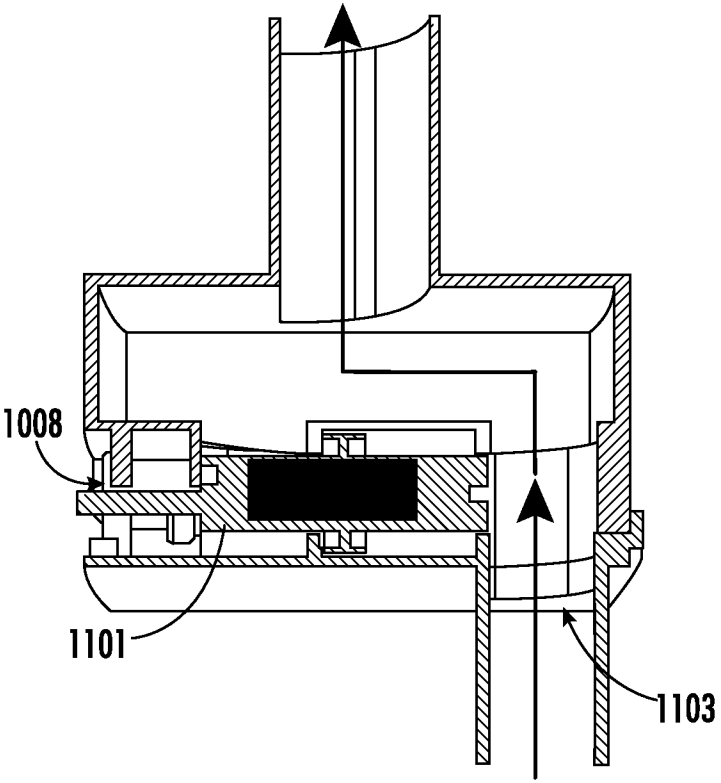
FIG. 11B shows an example of an actuatable valve in a cleaning position, consistent with embodiments of the present disclosure.

The premotor chamber 1004 includes a premotor chamber hatch 1006 configured to transition between a closed position (e.g., as shown in FIG. 10) and an open position (e.g., as shown in FIG. 11A). When in the closed position, air is substantially prevented from passing through a flow path adjustment opening 1008 and, when in the open position, air can pass through the flow path adjustment opening 1008. Additionally, or alternatively, an actuatable valve 1101 may be fluidly coupled to the flow path adjustment opening 1008 (see, e.g., FIGS. 11B and 11C). As shown in FIG. 11B, when the vacuum assembly 306 is disengaged from the docking station 400, the actuatable valve 1101 is in a cleaning position such that a dust cup opening 1103 is open and the flow path adjustment opening 1008 is closed. As shown in FIG. 11C, when the vacuum assembly 306 is engaging the docking station 400, the actuatable valve 1101 is in an evacuation position such that the dust cup opening 1103 is closed and the flow path adjustment opening 1008 is open. The actuatable valve 1101 may be biased towards the cleaning position such that, when the vacuum assembly 306 disengages the docking station 400, the actuatable valve 1101 transitions to the cleaning position.

As also shown, the vacuum cleaner dust cup 310 includes a wand hatch 1010. The wand hatch 1010 is configured to transition between an open position (e.g., as shown in FIG. 10) and a closed position (e.g., as shown in FIG. 11A). When in the open position, air can pass through the wand 303 and into the vacuum cleaner dust cup 310 and, when in the closed position, air is substantially prevented from passing through the wand 303 and into the vacuum cleaner dust cup 310. The vacuum cleaner dust cup 310 also includes an evacuation hatch 1012. The evacuation hatch 1012 is configured to transition between a closed position (e.g., as shown in FIG. 10) and an open position (e.g., as shown in FIG. 11A). When in the closed position, air is substantially prevented from passing through an evacuation opening 1014 and, when in the open position, air can pass through the evacuation opening 1014.

Figure 11E:
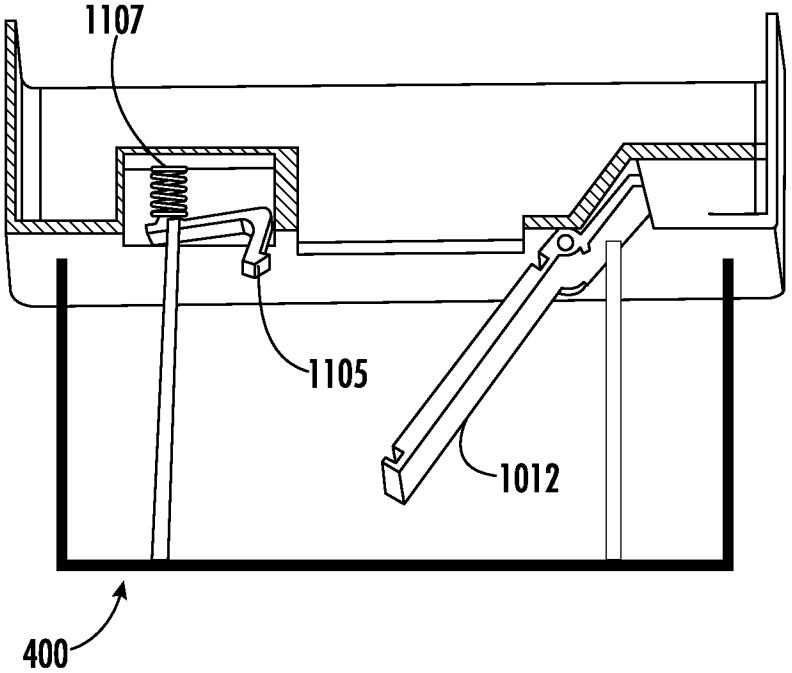
FIG. 11E shows a magnified schematic view of an example of the evacuation hatch of FIG. 11D in an open position, consistent with embodiments of the present disclosure.
Figure 11D:
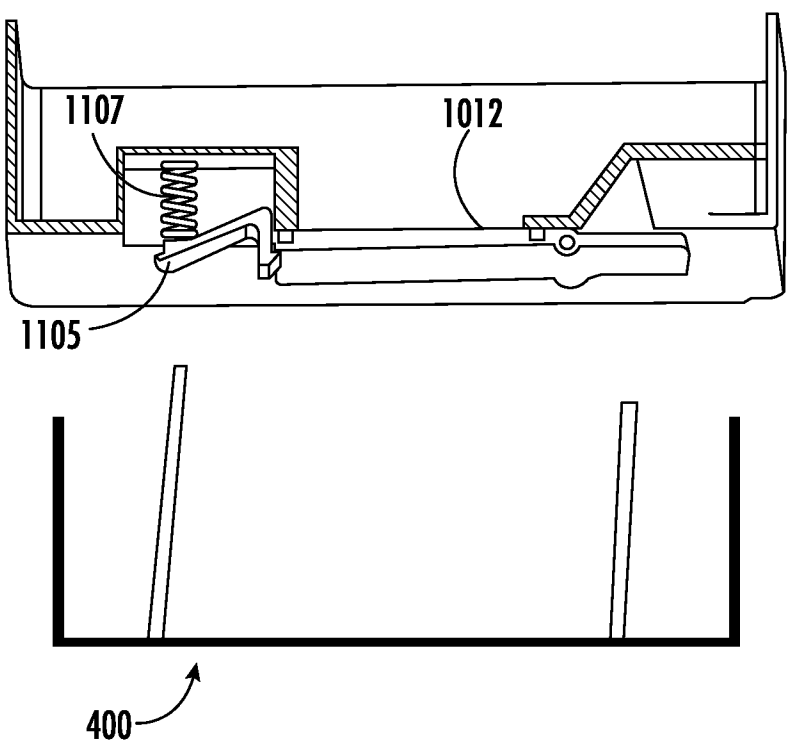
FIG. 11D shows a magnified schematic view of an example of an evacuation hatch in a closed position, consistent with embodiments of the present disclosure.

FIGS. 11D and 11E show a magnified schematic view of an example of the evacuation hatch 1012. As shown in FIG. 11D, the evacuation hatch 1012 may be retained in the closed position by an actuatable latch 1105. The actuatable latch 1105 can be biased towards a latching position using a latch biasing mechanism 1107 (e.g., a spring). As shown in FIG. 11E, the actuatable latch 1105 can be configured to be actuated in response to engaging the docking station 400 such that the evacuation hatch 1012 transitions to the open position. The evacuation hatch 1012 can be configured to transition to the open position in response to the evacuation hatch 1012 engaging the docking station 400. The evacuation hatch 1012 can be biased towards the closed position using a hatch biasing mechanism (e.g., a spring) such that, when the evacuation hatch 1012 disengages the docking station 400, the evacuation hatch 1012 is urged to the closed position.

Transitioning the premotor chamber hatch 1006, the wand hatch 1010, and the evacuation hatch 1012 between open and closed positions can cause the vacuum cleaner air flow path to transition between the cleaning flow path 314 and the evacuation flow path 802. For example, air may flow through the vacuum assembly 306 according to the cleaning flow path 314 when the premotor chamber hatch 1006 and evacuation hatch 1012 are in the closed position and the wand hatch 1010 is in the open position. By way of further example, air may flow through the vacuum assembly 306 according to the evacuation flow path 802 when the premotor chamber hatch 1006 and evacuation hatch 1012 are in the open position and the wand hatch 1010 is in the closed position.

FIG. 11A shows a cross-sectional view of an example of the vacuum assembly 306 and the wand 303 engaging to the docking station 400. As shown, when engaging the docking station 400, air flows according to the evacuation flow path 802. The evacuation flow path 802 extends from a bypass channel 1102 through the filter medium 1002 into the vacuum cleaner dust cup 310 and the docking station dust cup 408 through a docking station dust cup filter 1104 into a docking station duct 1106 and the premotor chamber 1004 and through the suction motor 312. As shown, air flowing through the filter medium 1002 according to the evacuation flow path 802 flows from the clean side 1007 of the filter medium 1002 to the debris collection side 1005 of the filter medium 1002. This may generally be referred to as a reverse direction of air flow through the filter medium 1002.

The bypass channel 1102 is configured to selectively fluidly couple the vacuum cleaner dust cup 310 to a surrounding environment. As such, when the bypass channel 1102 fluidly couples the vacuum cleaner dust cup 310 to the surrounding environment, the suction motor 312 causes air from the surrounding environment to be drawn into the vacuum cleaner dust cup 310 via the bypass channel 1102. Air drawn into the vacuum cleaner dust cup 310 via the bypass channel 1102 flows through the filter medium 1002 in the reverse direction. Such a configuration may cause at least a portion of any debris adhered to the debris collection side of 1005 of the filter medium 1002 to become unadhered (dislodged) from the debris collection side 1005 and become entrained in the air flowing along the evacuation flow path 802. At least a portion of debris entrained in the air may be deposited in the docking station dust cup 408.

The bypass channel 1102 may be at least partially defined in one or more of the vacuum assembly 306 and/or the docking station 400. As shown, the bypass channel 1102 is collectively defined by a vacuum assembly portion 1108 defined in the vacuum assembly 306 and a docking station portion 1110 defined in the vacuum assembly receptacle 406 of the docking station 400. The vacuum assembly portion 1108 of the bypass channel 1102 may include a valve 1112 configured to selectively fluidly couple the vacuum cleaner dust cup 310 to the surrounding environment. For example, the valve 1112 can be configured to transition from a closed position (e.g., as shown in FIG. 10) to an open position (e.g., as shown in FIG. 11A) in response to the vacuum cleaner 300 engaging the docking station 400.

Figure 12:
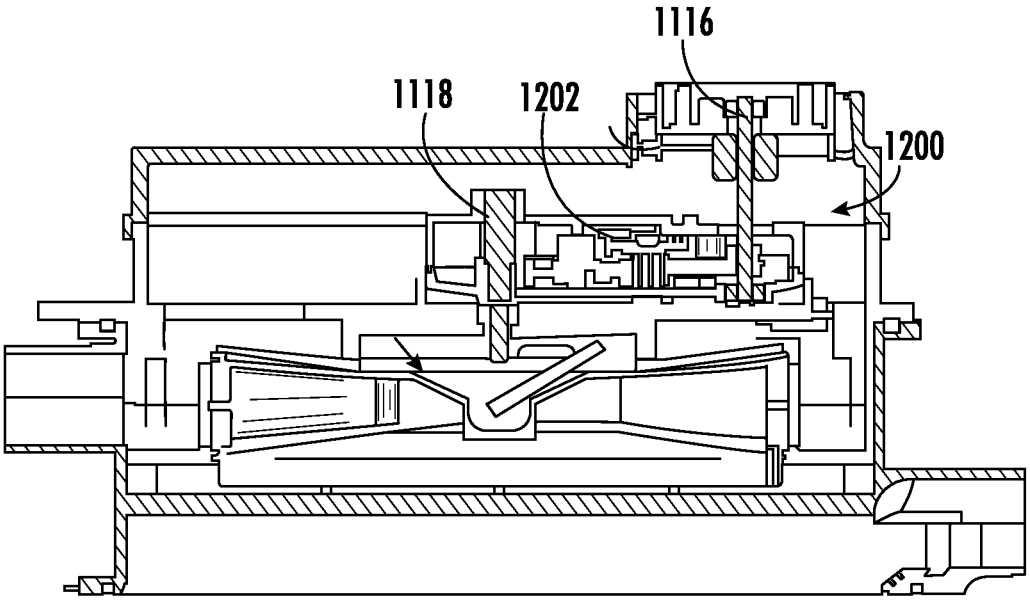
FIG. 12 is another cross-sectional view of a portion of the vacuum cleaner of FIG. 3 engaging the docking station of FIG. 4, consistent with embodiments of the present disclosure.

As shown, the bypass channel 1102 (e.g., the docking station portion 1110) includes a turbine 1114 configured to be rotated in response to air passing therethrough (e.g., air flowing along the evacuation flow path 802). The turbine 1114 can be coupled to a docking station drive shaft 1116 such that the docking station drive shaft 1116 rotates with the turbine 1114. The docking station drive shaft 1116 is configured to engage a vacuum assembly drive shaft 1118 when the vacuum cleaner 300 engages the docking station 400 such that the vacuum assembly drive shaft 1118 rotates with the docking station drive shaft 1116. For example, as shown in FIG. 11A, the vacuum assembly drive shaft 1118 and the docking station drive shaft 1116 can include corresponding friction couplings 1115 and 1117. By way of further example, as shown in FIG. 12, a drive train 1200 including a plurality of gears 1202 can rotationally couple the docking station drive shaft 1116 with the vacuum assembly drive shaft 1118. Rotation of the vacuum assembly drive shaft 1118 causes a wiper 1120 of the vacuum assembly 306 (e.g., the vacuum cleaner dust cup 310) to move relative to the filter medium 1002. For example, the wiper 1120 may be caused to oscillate through an oscillation angle (e.g., 45°, 90°, 135°, 180°, 225°, and/or any other angle). For example, the vacuum assembly drive shaft 1118 can be coupled to an oscillation arm 1119 such that the oscillation arm 1119 moves with the vacuum assembly drive shaft 1118. An oscillation bar 1121 can be coupled to the oscillation arm 1119 and the wiper 1120 such that the oscillation bar 1121 extends transverse to the oscillation arm 1119 and moves about the rotation axis of the vacuum assembly drive shaft 1118. As such, rotation of the oscillation bar 1121 causes the wiper 1120 to oscillate. In other words, the wiper 1120 may be generally described as being configured to move in response to a rotation of the turbine 1114.

Movement (e.g., oscillation) of the wiper 1120 relative to the filter medium 1002 may cause at least a portion of any debris adhered to the debris collection side 1005 of the filter medium 1002 to become unadhered from the debris collection side. The wiper 1120 may be spaced apart from the filter medium 1002 such that the wiper does not engage (e.g., contact) the filter medium 1002. For example, the wiper 1120 may be configured such that air can flow through a wiper channel 1122 defined therein. The wiper channel 1122 is fluidly coupled to the bypass channel 1102 such that air flowing along the evacuation flow path 802 flows through the bypass channel 1102 and the wiper channel 1122 before passing through the filter medium 1002 in the reverse direction. The wiper channel 1122 can be configured to increase a flow velocity of air flowing therethrough (e.g., a width of the wiper channel 1122 can decrease from a wiper channel inlet 1124 to a wiper channel outlet 1126). For example, an outlet width 1128 (see FIG. 13) of the wiper channel outlet 1126 may measure in a range of 1% to 25% of a filter width 1130 (see FIG. 13) of the filter medium 1002. The increased flow velocity of air exiting the wiper channel 1122 may better urge debris adhered to the debris collection side 1005 of the filter medium 1002 to become unadhered from the debris collection side 1005. Oscillation of the wiper 1120 may allow the wiper channel outlet 1126 to be small/narrow relative to the surface of the clean side 1007 of the filter medium 1002.

Figure 13:
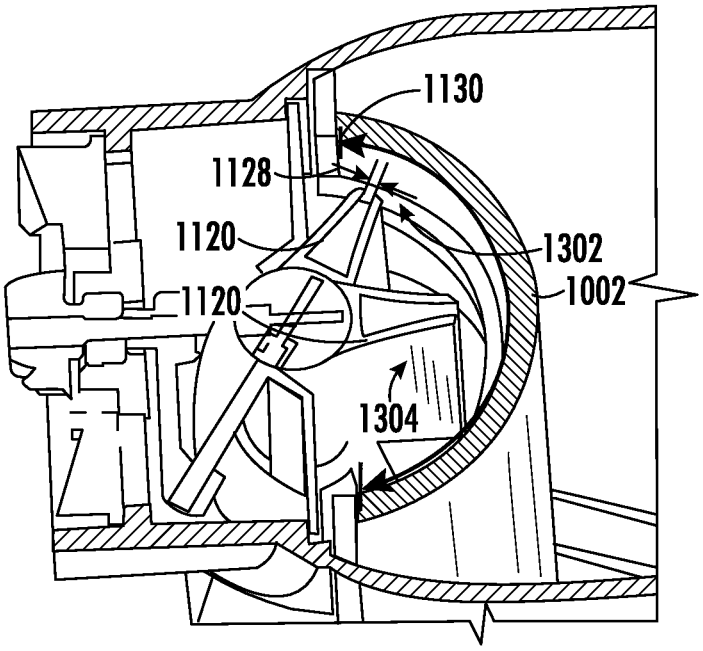
FIG. 13 is a cross-sectional view of a portion of the vacuum cleaner of FIG. 3 showing a wiper configured to move relative to a filter medium, consistent with embodiments of the present disclosure.

FIG. 13 shows a perspective cross-sectional view of the vacuum assembly 306. The wiper 1120 is shown in a first position 1302 and a second position 1304 for convenience of illustrating the oscillation.

Figure 14A:
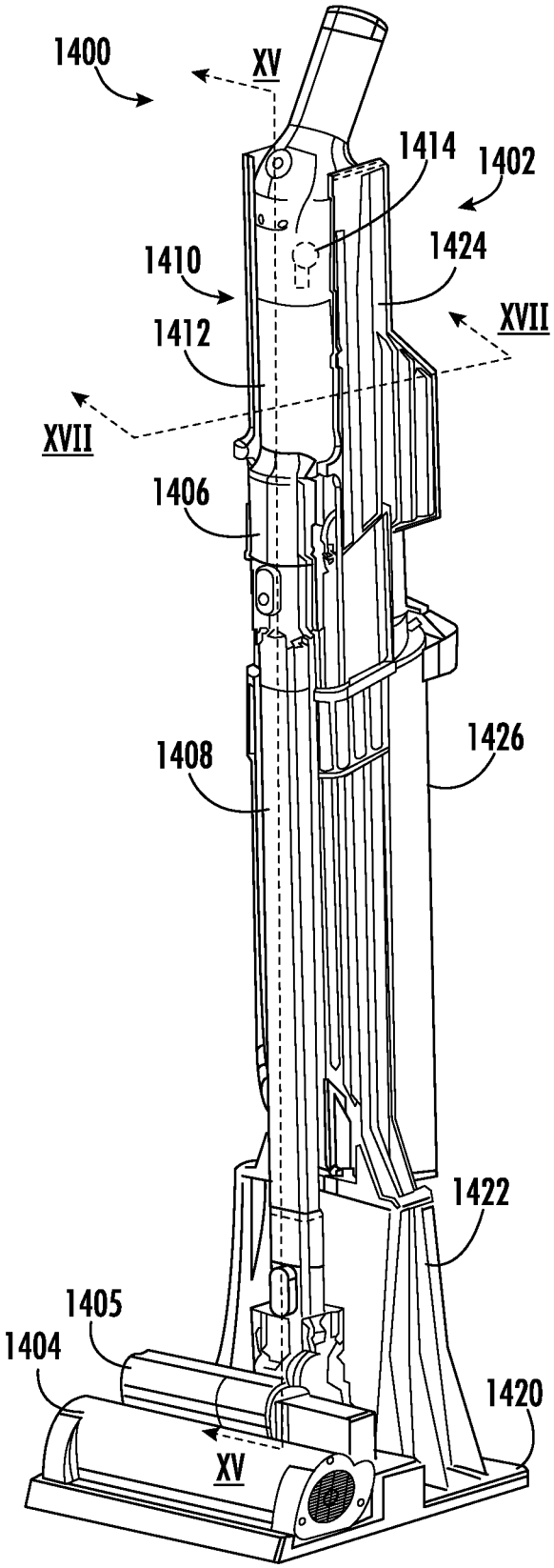
FIG. 14A is a perspective view of a vacuum cleaner engaging a docking station, consistent with embodiments of the present disclosure.

FIG. 14A shows a perspective view of a vacuum cleaner 1400 engaging a docking station 1402, which may be examples of the vacuum cleaner 100 of FIG. 1 and docking station 200 of FIG. 2, respectively. As shown, the vacuum cleaner 1400 includes a surface cleaning head 1404, a wand 1406 coupled to a wand extension 1408, the wand 1406 and wand extension 1408 being fluidly coupled to the surface cleaning head 1404, and a vacuum assembly 1410 fluidly coupled to the wand 1406. The vacuum assembly 1410 includes a vacuum cleaner dust cup 1412 and a suction motor 1414 (shown schematically in hidden lines). The surface cleaning head 1404 can include one or more agitators configured to be rotated by one or more motors. The one or more motors can be powered by a power source 1405 (e.g., one or more batteries). The power source 1405 may be included with the surface cleaning head 1404. Additionally, or alternatively, the wand extension 1408 and/or the vacuum assembly 1410 may include the power source 1405 (e.g., one or more batteries). In some instances, the one or more motors driving the one or more agitators may be powered in response to a pressure sensor detecting a pressure change generated by the starting of the suction motor 1414. In other words, the one or more agitators may be caused to rotate in response to a detected pressor change.

Figure 14B:
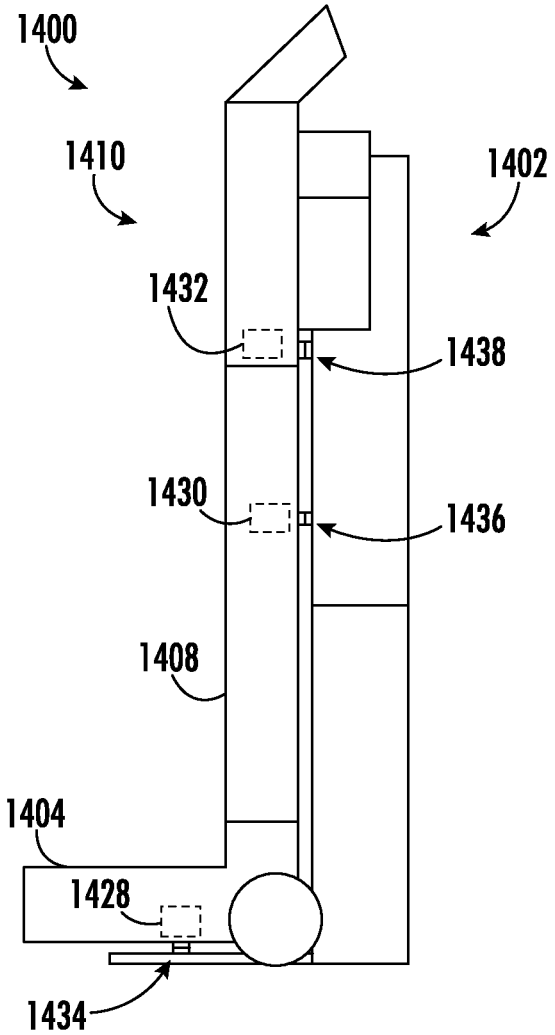
FIG. 14 B is a schematic example of the vacuum cleaner engaging the docking station of FIG. 14A, consistent with embodiments of the present disclosure.

In some instances, the vacuum cleaner 1400 includes a plurality of power sources 1405 (e.g., one in the surface cleaning head 1404, one in the wand extension 1408, and/or one in the vacuum assembly 1410). In these instances, the docking station 1402 may include a plurality of charging contacts, wherein each power source 1405 has corresponding charging contacts. The charging contacts for each power source 1405 may be associated with a dedicated charging circuit. As such, each of the power sources 1405 can be independently recharged. Such a configuration may allow a remaining power level of each of the power sources 1405 to be considered when recharging the power sources 1405 such that, for example, one or more of the power sources 1405 are not over charged. FIG. 14B shows a schematic example of the vacuum cleaner 1400 and the docking station 1402, wherein the surface cleaning head 1404 includes a first power source 1428, the wand extension 1408 includes a second power source 1430, and the vacuum assembly 1410 includes a third power source 1432. The first, second, and third power sources 1428, 1430, and 1432 each correspond to respective charging contacts 1434, 1436, and 1438, wherein each of the charging contacts 1434, 1436, and 1438 are electrically coupled to respective charging circuits. As such, each of the first, second, and third power sources 1428, 1430, and 1432 can be independently recharged. As shown, the charging contacts 1434, 1436, and 1438 include a docking station half that is electrically coupled to a power supply of the docking station 1402 and a vacuum cleaner half that is electrically coupled to a respective one of the power sources 1428, 1430, and 1432. In some instances, a configuration, orientation, and/or position of at least a portion of the vacuum cleaner 1400 may be adjusted upon engaging the docking station 1402 such that an electrical coupling between respective halves of one or more of the charging contacts 1434, 1436, and/or 1438 can be made. The power sources 1428, 1430, and 1432 may be examples of the power source 1405.

Returning to FIG. 14A, as also shown, the docking station 1402 includes a base 1420 configured to receive the surface cleaning head 1404 of the vacuum cleaner 1400, an upright section 1422 extending from the base 1420, a vacuum assembly receptacle 1424 configured to receive at least a portion of the vacuum assembly 1410, and a docking station dust cup 1426 fluidly coupled to the vacuum assembly receptacle 1424. The docking station 1402 is configured to transition a vacuum cleaner flow path extending within the vacuum cleaner 1400 from a cleaning flow path 1500 (see FIG. 15) to an evacuation flow path (see FIG. 16).

Figure 15:
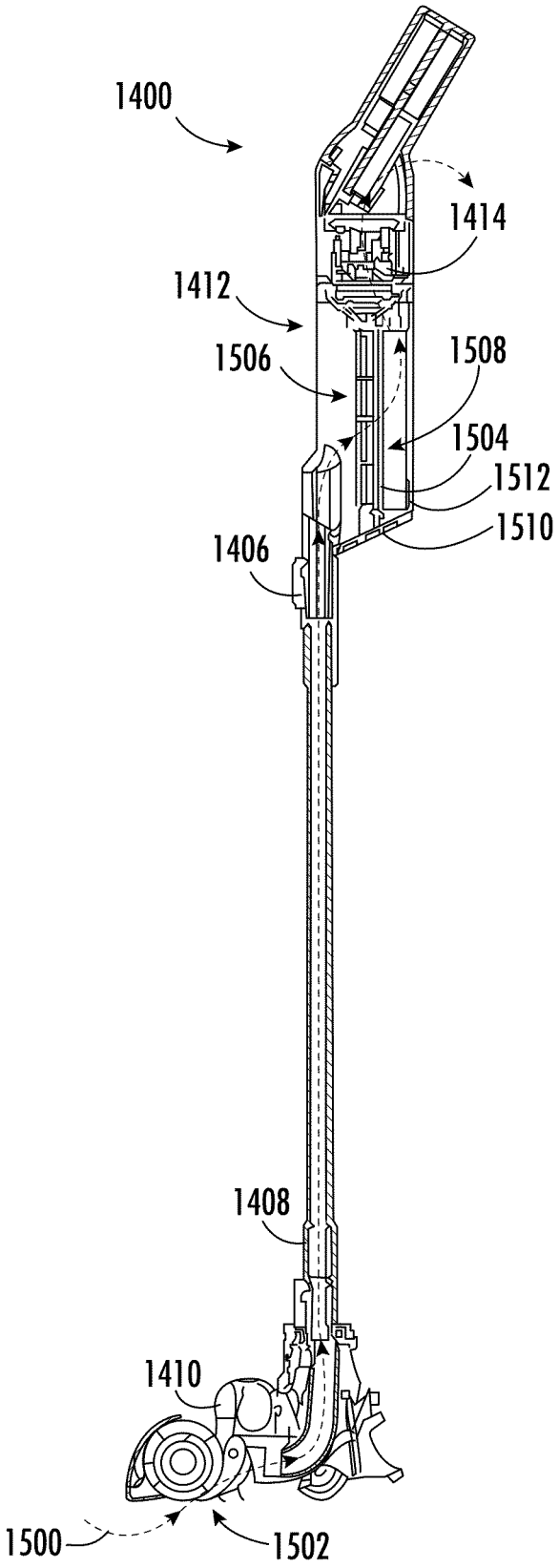
FIG. 15 is a cross-sectional view of the vacuum cleaner of FIG. 14A, consistent with embodiments of the present disclosure.

FIG. 15 shows a cross-sectional view of the vacuum cleaner 1400 disengaged from the docking station 1402 taken along the line XV-XV of FIG. 14A. As shown, the cleaning flow path 1500 extends from an inlet 1502 of the surface cleaning head 1404 through the wand extension 1408 and the wand 1406 into the vacuum cleaner dust cup 1412 through a filter medium 1504 and into the suction motor 1414. The cleaning flow path 1500 flows from a debris collection side 1506 of the filter medium 1504 to a clean side 1508 of the filter medium 1504. In other words, air can generally be described as flowing in a forward direction through the filter medium 1504 when moving along the cleaning flow path 1500. The filter medium 1504 may be a mesh filter, a high-efficiency particulate air (HEPA) filter, and/or any other type of filter.

As also shown, the vacuum cleaner dust cup 1412 can include a dust cup door 1510. The dust cup door 1510 can be configured to be pivotally coupled to a dust cup body 1512 such that the dust cup door 1510 can transition between an open and closed position. When in the open position, debris within the vacuum cleaner dust cup 1412 can be emptied therefrom.

Figure 16:
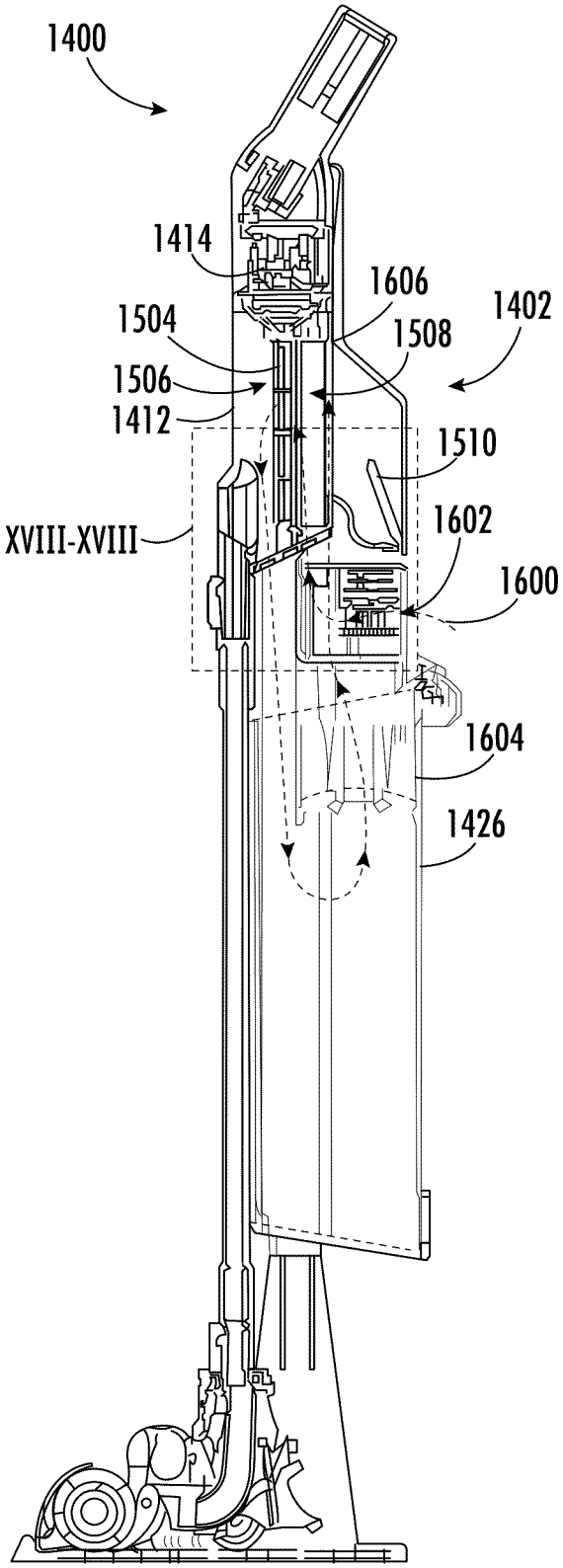
FIG. 16 is a cross-sectional view of the vacuum cleaner of FIG. 14A engaging the docking station of FIG. 14A, consistent with embodiments of the present disclosure.

FIG. 16 shows a cross-sectional view of the vacuum cleaner 1400 engaging the docking station 1402 taken along the line XV-XV of FIG. 14A. When the vacuum cleaner 1400 is engaging the docking station 1402, the cleaning flow path 1500 is transitioned to an evacuation flow path 1600. As shown, the evacuation flow path 1600 flows into a bypass channel 1602 through the filter medium 1504 into the vacuum cleaner dust cup 1412 and the docking station dust cup 1426 through a cyclonic separator 1604 of the docking station 1402 into a duct 1606 (see, also, FIG. 17) and through the suction motor 1414. The evacuation flow path 1600 extends through the filter medium 1504 from the clean side 1508 to the debris collection side 1506. In other words, air can generally be described as flowing in a reverse direction through the filter medium 1504 when moving along the evacuation flow path 1600. The duct 1606 may be closed when the vacuum cleaner 1400 disengages the docking station 1402, preventing air from flowing therethrough. For example, the dust cup door 1510 can extend over an opening to the duct 1606 preventing air from flowing through the duct 1606.

As shown, when the vacuum cleaner 1400 is engaging the docking station 1402, the dust cup door 1510 is pivoted to an open position (e.g., in response to the vacuum cleaner 1400 engaging docking station 1402). The dust cup door 1510 can be biased towards a closed position such that when the vacuum cleaner 1400 disengages the docking station 1402 the dust cup door 1510 is urged to the closed position. As such, the dust cup door 1510 can transition between the open and closed positions without a user having to directly manipulate the dust cup door 1510.

When in the open position, at least a portion of the dust cup door 1510 can be received within a portion of the docking station 1402 such that the vacuum cleaner dust cup 1412 is fluidly coupled with the docking station dust cup 1426. As such, when the dust cup door 1510 is in the open position debris contained within the vacuum cleaner dust cup 1412 may be deposited into the docking station dust cup 1426. When the suction motor 1414 is activated such that air moves along the evacuation flow path 1600, additional debris may become unadhered from the filter medium 1504 and be deposited in the docking station dust cup 1426.

Figure 17:
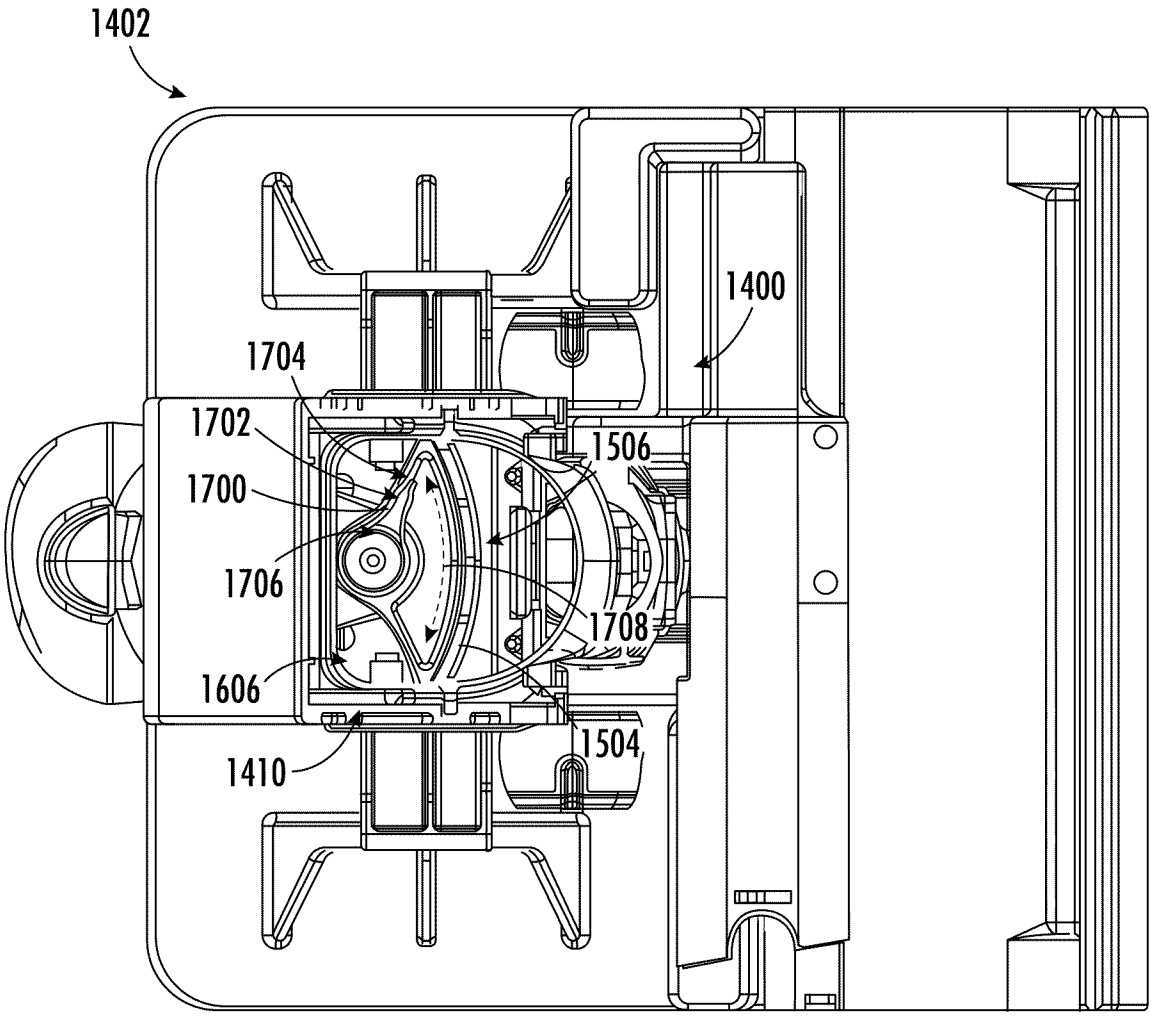
FIG. 17 is another cross-sectional view of the vacuum cleaner of FIG. 14A engaging the docking station of FIG. 14A, consistent with embodiments of the present disclosure.

FIG. 17 shows a cross-sectional view of the vacuum cleaner 1400 engaging the docking station 1402 taken along the line XVII-XVII of FIG. 14A. As shown, the vacuum cleaner 1400 can include a wiper 1700 configured to move relative to the filter medium 1504. The wiper 1700 can define a wiper channel 1702 through which air moving along the evacuation flow path 1600 moves. As shown, an outlet 1704 of the wiper channel 1702 has a width that measures narrower than an inlet 1706 of the wiper channel 1702. As such, a velocity of air moving along the evacuation flow path 1600 within the wiper channel 1702 increases towards the outlet 1704. The increased velocity may cause at least a portion of any debris adhered to a debris collection side 1506 of the filter medium 1504 to become unadhered from the debris collection side 1506 and become entrained in the air flowing moving the evacuation flow path 1600.

The wiper 1700 can be configured to move along an arcuate path 1708 that generally corresponds to an arcuate shape of the filter medium 1504. In some instances, the wiper 1700 can be configured to oscillate along the arcuate path 1708 when air is moving along the evacuation flow path 1600. In other instances, the wiper 1700 can be configured to move along the arcuate path 1708 only once when air is moving along the evacuation flow path 1600. In these instances, the wiper 1700 can be transitioned to a wiped position along the arcuate path 1708 in response to movement of air along the evacuation flow path 1600 and can be returned from the wiped position to a starting position along the arcuate path 1708 when air is no longer moving along the evacuation flow path 1600 and/or when at least a portion of the vacuum cleaner 1400 (e.g., the vacuum assembly 1410) is disengaged from the docking station 1402 (e.g., in response to a force exerted by a biasing mechanism such as a spring).

Figure 18:
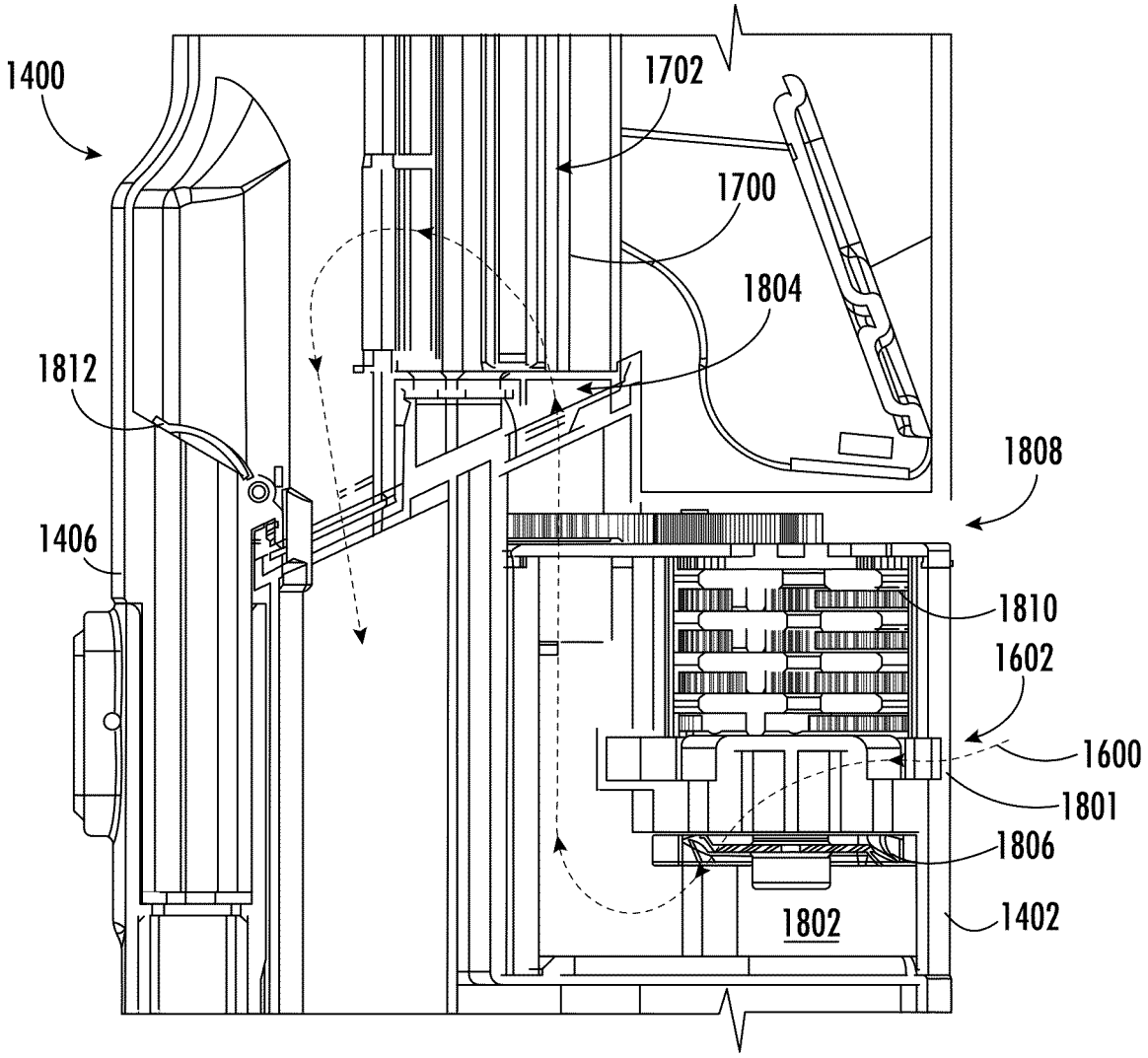
FIG. 18 is a magnified cross-sectional view of a portion of the vacuum cleaner of FIG. 14A engaging the docking station of FIG. 14A, consistent with embodiments of the present disclosure.

FIG. 18 is a magnified cross-sectional view that generally corresponds to the region XVIII-XVIII of FIG. 16. As shown, the bypass channel 1602 includes a first bypass portion 1802 defined in the docking station 1402, a second bypass portion 1804 defined in the vacuum cleaner 1400, and one or more bypass inlets 1801. The one or more bypass inlets may have a collective inlet area that measures, for example, in a range of 100 square millimeters ($mm^2$) to 500 $mm^2$. The first bypass portion 1802 includes at least one turbine 1806 configured to be rotated by air flowing along the evacuation flow path 1600. Rotation of the turbine 1806 causes a movement in the wiper 1700. The second bypass portion 1804 can fluidly couple the first bypass portion 1802 to the wiper channel 1702 such that air moving along the evacuation flow path 1600 can flow through the wiper channel 1702. In some instances, the second bypass portion 1804 can be configured to rotate with the wiper 1700.

As shown, the turbine 1806 can be coupled to a drive train 1808. The drive train 1808 can include a plurality of gears 1810 configured to transmit power from the turbine 1806 to the wiper 1700. For example, the plurality of gears 1810 may be planetary gears. The drive train 1808 can be configured to reduce the rotation speed of the wiper 1700 relative to the rotational speed of the turbine 1806.

Figure 19:
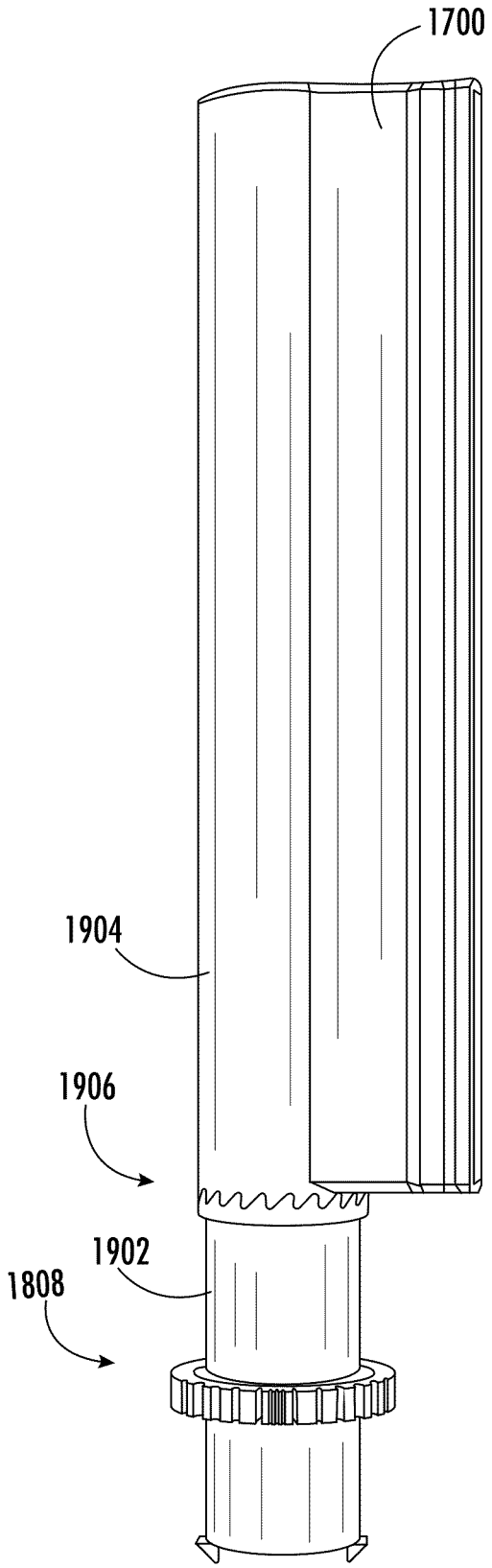
FIG. 19 shows a perspective view of a docking station drive shaft and a vacuum assembly drive shaft, consistent with embodiments of the present disclosure.

The drive train 1808 can be configured to drive a docking station drive shaft 1902 and a vacuum assembly drive shaft 1904 (see FIG. 19, showing the docking station drive shaft 1902 and the vacuum assembly drive shaft 1904 removed from vacuum cleaner 1400 and docking station 1402). As shown, the docking station drive shaft 1902 and vacuum assembly drive shaft 1904 include interlocking protrusions 1906 (e.g., teeth) configured to engage when the vacuum cleaner 1400 engages the docking station 1402. In instances when the wiper 1700 makes only a single pass over the filter medium 1504, the wiper 1700 may be biased towards a starting position by a biasing mechanism (e.g., a spring). When the interlocking protrusions 1906 disengage in response to the vacuum cleaner 1400 being disengaged from the docking station 1402, the biasing mechanism may urge the wiper 1700 towards the starting position.

As also shown, when the vacuum cleaner 1400 engages the docking station 1402, a wand hatch 1812 is transitioned to a closed position. When in the closed position, the wand hatch 1812 prevents and/or reduces air flowing through the wand 1406. As such, air moves along the evacuation flow path 1600. When the vacuum cleaner 1400 disengages the docking station 1402, the wand hatch 1812 can transition to an open position such that air can flow through the wand 1406.

Figure 20:
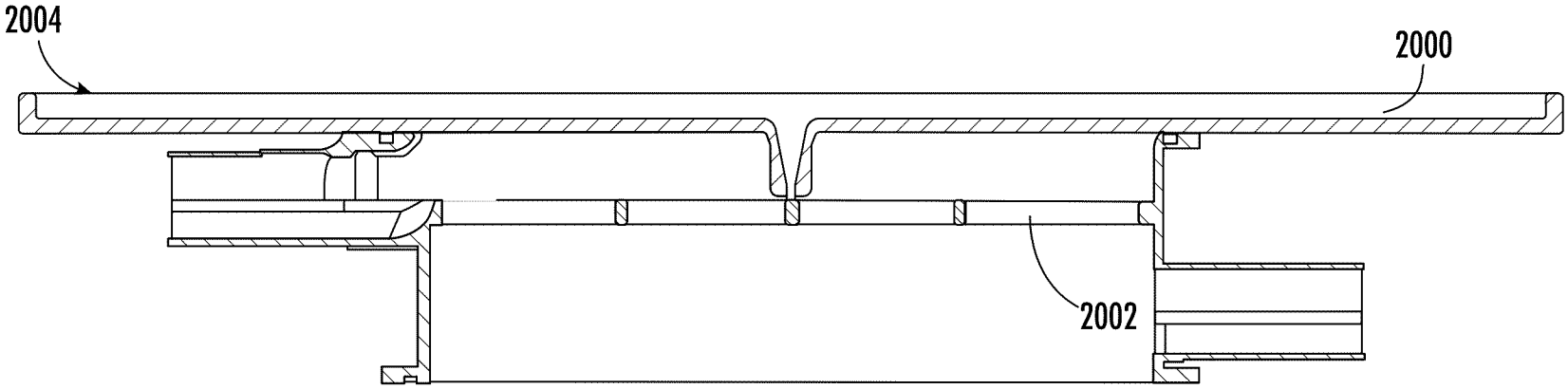
FIG. 20 is a perspective view of a wiper and a filter medium, consistent with embodiments of the present disclosure.

FIG. 20 shows a schematic example of a wiper 2000 configured move relative to a filter medium 2002 that can be configured to be used with any one or more of the vacuum cleaners disclosed herein. As shown, the filter medium 2002 is substantially planar. As such, the wiper 2000 can be configured to move linearly relative to the filter medium 2002. The wiper 2000 can be configured such that air can flow through a passageway 2004 defined therein.

An example of a docking station for a vacuum cleaner, consistent with the present disclosure, may include a receptacle configured to engage at least a portion of the vacuum cleaner such that, in response to engaging the receptacle, a vacuum cleaner flow path extending within the vacuum cleaner is transitioned from a cleaning flow path to an evacuation flow path, a suction motor of the vacuum cleaner being configured to urge air along the vacuum cleaner flow path and a docking station dust cup configured to receive debris from a vacuum cleaner dust cup of the vacuum cleaner.

In some instances, the docking station may further include a base and an upright section extending from the base, the receptacle being coupled to the upright section. In some instances, the receptacle may define at least a portion of a bypass channel, the evacuation flow path extending through the bypass channel. In some instances, the bypass channel may include a turbine configured to be rotated in response to air moving along the evacuation flow path. In some instances, rotation of the turbine may cause a wiper within the vacuum cleaner to move relative to a filter medium within the vacuum cleaner.

An example of a vacuum cleaner configured to engage a docking station, consistent with the present disclosure, may include a vacuum assembly configured such that, in response to the vacuum assembly engaging the docking station, a vacuum cleaner flow path extending within the vacuum assembly transitions from a cleaning flow path to an evacuation flow path. The vacuum assembly may include a vacuum cleaner dust cup and a suction motor configured to urge air along the vacuum cleaner flow path.

In some instances, the evacuation flow path may be configured such that air flowing along the evacuation flow path urges debris within the vacuum cleaner dust cup into a docking station dust cup of the docking station. In some instances, the vacuum assembly may include a filter medium. In some instances, the vacuum assembly may include a wiper, the wiper being configured to move relative to the filter medium. In some instances, the wiper may be configured to oscillate along an arcuate path, the arcuate path generally corresponding to a shape of the filter medium. In some instances, the wiper may define a wiper channel, the wiper channel being configured to increase a velocity of air flowing therethrough. In some instances, the evacuation flow path may extend through the wiper channel. In some instances, the wiper may be configured to move in response to a rotation of a turbine.

An example of a cleaning system may include a vacuum cleaner and a docking station. The vacuum cleaner may include a vacuum assembly. The vacuum assembly may include a vacuum cleaner dust cup and a suction motor configured to urge air along a cleaning flow path. The docking station may include a receptacle configured to engage at least a portion of the vacuum cleaner such that, in response to at least a portion the vacuum cleaner engaging the receptacle, the cleaning flow path is transitioned to an evacuation flow path, the suction motor being further configured to urge air along the evacuation flow path and a docking station dust cup configured to receive debris from the vacuum cleaner dust cup.

In some instances, the docking station may further include a base and an upright section extending from the base, the receptacle being coupled to the upright section. In some instances, the receptacle may define at least a portion of a bypass channel, the evacuation flow path extending through the bypass channel. In some instances, the bypass channel may include a turbine configured to be rotated in response to air moving along the evacuation flow path. In some instances, the vacuum assembly may include a filter medium and a wiper, the wiper being configured to move in response to rotation of the turbine. In some instances, the wiper may define a wiper channel, the wiper channel being configured to increase a velocity of air flowing therethrough. In some instances, the evacuation flow path may extend through the wiper channel.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A docking station for a vacuum cleaner having a cleaner dust cup with a filter, the docking station comprising:

a receptacle configured to engage at least a portion of the vacuum cleaner such that, in response to engaging the receptacle, a vacuum cleaner flow path extending within the vacuum cleaner is transitioned from a cleaning flow path to an evacuation flow path, wherein transitioning from the cleaning flow path to the evacuation flow path includes causing an evacuation hatch of the cleaner dust cup to open an evacuation opening of the cleaner dust cup and causing an inlet hatch of the cleaner dust cup to close an inlet of the cleaner dust cup, a suction motor of the vacuum cleaner being configured to urge air along the vacuum cleaner flow path, wherein air flowing along the evacuation flow path flows through the filter in a direction opposite to that of air flowing along the cleaning flow path; and a docking station dust cup configured to receive debris from the cleaner dust cup through the evacuation opening in response to the suction motor of the vacuum cleaner urging air along the evacuation flow path.

2. The docking station of claim 1, further comprising a base and an upright section extending from the base, the receptacle being coupled to the upright section.

3. The docking station of claim 1, wherein the receptacle defines at least a portion of a bypass channel, the evacuation flow path extending through the bypass channel.

4. The docking station of claim 3, wherein the bypass channel includes a turbine configured to be rotated in response to air moving along the evacuation flow path.

5. The docking station of claim 4, wherein rotation of the turbine causes a wiper within the vacuum cleaner to move relative to the filter.

6. A vacuum cleaner configured to engage a docking station having a docking station dust cup, the vacuum cleaner comprising:

a vacuum assembly configured such that, in response to the vacuum assembly engaging the docking station, a vacuum cleaner flow path extending within the vacuum assembly transitions from a cleaning flow path to an evacuation flow path, the vacuum assembly including:

a vacuum cleaner dust cup having an inlet, an evacuation opening, an inlet hatch configured to selectively close the inlet, and an evacuation hatch configured to selectively close the evacuation opening, wherein, when the vacuum assembly is transitioned from the cleaning flow path to the evacuation flow path, the evacuation hatch is opened and the inlet hatch is closed;

a filter; and a suction motor configured to urge air along the vacuum cleaner flow path, wherein, when the suction motor urges air to flow along the evacuation flow path, the air flows through the filter in a direction opposite to that of air flowing along the cleaning flow path and urges debris through the evacuation opening of the vacuum cleaner dust cup into the docking station dust cup.

7. The vacuum cleaner of claim 6, wherein the vacuum assembly includes a wiper, the wiper being configured to move relative to the filter.

8. The vacuum cleaner of claim 7, wherein the wiper is configured to oscillate along an arcuate path, the arcuate path generally corresponding to a shape of the filter.

9. The vacuum cleaner of claim 7, wherein the wiper defines a wiper channel, the wiper channel being configured to increase a velocity of air flowing therethrough.

10. The vacuum cleaner of claim 9, wherein the evacuation flow path extends through the wiper channel.

11. The vacuum cleaner of claim 7, wherein the wiper is configured to move in response to a rotation of a turbine.

12. A cleaning system comprising:

a vacuum cleaner, the vacuum cleaner including a vacuum assembly, the vacuum assembly including:

a vacuum cleaner dust cup having an inlet, an evacuation opening, an inlet hatch configured to selectively close the inlet, and an evacuation hatch configured to selectively close the evacuation opening;

a filter; and a suction motor configured to urge air along a cleaning flow path; and a docking station, the docking station including:

a receptacle configured to engage at least a portion of the vacuum cleaner such that, in response to at least a portion the vacuum cleaner engaging the receptacle, the cleaning flow path is transitioned to an evacuation flow path by transitioning the evacuation hatch to an open position and the inlet hatch to a closed position, the suction motor being further configured to urge air along the evacuation flow path, wherein air flowing along the evacuation flow path flows through the filter in a direction opposite to that of air flowing along the cleaning flow path; and a docking station dust cup configured to receive debris from the evacuation opening of the vacuum cleaner dust cup in response to the suction motor of the vacuum cleaner urging air along the evacuation flow path.

13. The cleaning system of claim 12, wherein the docking station further includes a base and an upright section extending from the base, the receptacle being coupled to the upright section.

14. The cleaning system of claim 12, wherein the receptacle defines at least a portion of a bypass channel, the evacuation flow path extending through the bypass channel.

15. The cleaning system of claim 14, wherein the bypass channel includes a turbine configured to be rotated in response to air moving along the evacuation flow path.

16. The cleaning system of claim 15, wherein the vacuum assembly includes a wiper, the wiper being configured to move in response to rotation of the turbine.

17. The cleaning system of claim 16, wherein the wiper defines a wiper channel, the wiper channel being configured to increase a velocity of air flowing therethrough.

18. The cleaning system of claim 17, wherein the evacuation flow path extends through the wiper channel.

* * * * *